US005643096A

United States Patent [19]

Lowe

[11] Patent Number: 5,643,096

[45] Date of Patent: Jul. 1, 1997

[54] SENSOR APPARATUS FOR ACTIVATING A PNEUMATIC CIRCUIT

[76] Inventor: Richard D. Lowe, 253 Bovie Hill Rd., Hoosick Falls, N.Y. 12090

[21] Appl. No.: 613,456

[22] Filed: Mar. 11, 1996

[51] Int. Cl.[6] ..... A63B 57/00

[52] U.S. Cl. ..... 473/135; 473/134

[58] Field of Search ..... 473/132, 133, 473/134, 135, 136, 137; 124/56, 58, 60, 70, 71, 73, 76

[56] References Cited

U.S. PATENT DOCUMENTS

| | | | |
|---|---|---|---|
| 2,618,480 | 11/1952 | Williams | 473/135 |
| 3,378,263 | 4/1968 | Turnau et al. | 473/135 |
| 4,741,537 | 5/1988 | Adam | 473/135 |
| 5,016,886 | 5/1991 | Gould | 473/135 |
| 5,145,176 | 9/1992 | Lipson | 473/135 |
| 5,282,629 | 2/1994 | Eckstein | 473/135 |
| 5,348,305 | 9/1994 | Lowe | 473/135 |
| 5,383,442 | 1/1995 | Tippmann | 124/76 |

*Primary Examiner*—Steven Wong
*Attorney, Agent, or Firm*—Kerkam, Stowell, Kondracki & Clarke; Dennis P. Clarke

[57] ABSTRACT

An apparatus is provided to detect the presence or absence of an object thereon in order to actuate a pneumatic circuit. In particular, the apparatus is directed to detecting the presence or absence of a golf ball on a tee of an automatic golf ball teeing apparatus. The sensing apparatus includes a plunger engaged with a tee on which the golf ball rests. The plunger has a groove formed therein. The groove of the plunger is operatively engaged with a lever of a valve of a pneumatic circuit to be actuated. The plunger rests on a spring such that when a golf ball is present, the spring is compressed and the groove and lever of the valve keep the valve in a closed position. When the object is absent, the spring forces the plunger, and thus the groove, into an operative position in which the lever of the valve causes the valve to vent air. When the valve vents air, the pneumatic circuit is actuated and automatic replacement of the object is initiated.

11 Claims, 5 Drawing Sheets

SENSOR APPARATUS FOR ACTIVATING A PNEUMATIC CIRCUIT

BACKGROUND OF THE INVENTION

1. Field of the Invention

The present invention relates to an apparatus for sensing the presence or absence of an object in order to actuate a pneumatic circuit. In a preferred embodiment, the present invention is directed to an apparatus for detecting the presence or absence of a golf ball on a tee of an automatic golf ball teeing apparatus.

2. Discussion of the Prior Art

Numerous devices exist for detecting the presence or absence of an object in order to actuate a pneumatic circuit. Among these devices, is that disclosed in U.S. Pat. No. 5,348,305, to Lowe, the inventor of the present invention. The sensor system disclosed by Lowe is directed to the sensing of the presence or absence of a golf ball on a tee of an automatic golf ball teeing device. To achieve this automatic sensing function, whereby the pneumatic circuit engages an actuator for replacing a ball on the tee when the sensing circuit indicates the absence of a ball on the tee, a bore is disposed such that it is in fluidic communication with a central aperture of the tee. A non-contacting air limit switch assembly provides a continuous regulated sensing jet of air through a flexible conduit which is in fluidic communication with the bore and the central aperture of the tee. The sensing jet of air escapes through an open mouth of the hollow tee. The assembly includes a pressure regulator, a non-contacting air limit switch and a fluidic interface valve. When the sensing jet is uninterrupted by contact with a solid object, no supply air passes through the fluidic interface valve. Conversely, when the sensing jet is interrupted by the presence of a solid object, such as, for example, a golf ball coming to rest on the open mouth of the tee, the air supply passes through the interface valve of the pneumatic circuit. Upon passing through the interface valve, the air supply actuates a switch that causes the pneumatic reciprocation device to be engaged to place a golf ball on the vacant tee.

While the device disclosed by Lowe operates in an acceptable manner, there are numerous attendant disadvantages associated with the sensing configuration of the Lowe device. Among these disadvantages is the inefficient use of supply air. The Lowe device wastes excessive amounts of compressed air by having air escaping throughout the ball replacement process. Moreover, the sensing device of Lowe is unnecessarily complex. It is also important that the apparatus be capable of withstanding the shock force of an object striking the golf ball, such as, for example, a golf club. Having the air supply in fluidic contact with the tee may potentially render the prior system vulnerable to damage from the shock force of a club striking the ball and tee.

SUMMARY OF THE INVENTION

The present invention provides an improved apparatus for sensing the presence of absence of an object in order to actuate a pneumatic circuit that overcomes the deficiencies of known sensing systems and is an improvement over my prior invention disclosed in U.S. Pat. No. 5,348,305. In particular, the present invention provides an apparatus for sensing the presence or absence of an object wherein the construction thereof is simplified and the efficiency thereof is improved.

Accordingly, it is an object of the present invention to provide a simple and efficient apparatus for sensing the presence or absence of an object in order to actuate a pneumatic circuit.

It is another object of the present invention to provide an apparatus for sensing the presence or absence of an object that wastes a minimum of compressed air.

It is still another object of the present invention to provide an apparatus that is capable of withstanding the shock forces of an object, such as, for example, a golf ball, being struck with significant force, such as that generated by swinging a golf club.

Yet another object of the present invention is to provide an apparatus that is capable of sensing the presence or absence of a relatively light object.

An additional object of the present invention is to provide a sensing apparatus that facilitates automatic teeing of a golf ball without manual or user intervention.

These and other objects, and their attendant advantages, are achieved by the present invention, which provides an improved apparatus for sensing the presence or absence of an object comprising: a plunger adapted to receive the object, said plunger having a groove formed therein, said groove being adapted to receive a controlling lever of a valve; a valve for controlling air flow in a pneumatic actuating circuit, said valve having a lever operatively coupled thereto for venting and preventing air flow through said valve, said lever being operatively engaged with said groove of said plunger; and a spring having a predetermined tension, said plunger being operatively coupled to said spring, wherein said spring forces said plunger into an operative position when no object is present, said operative position causing said groove to actuate said lever of said valve to vent air through said valve.

In an alternative embodiment, the plunger is coupled with a flexible golf tee such that presence of a golf ball on the tee causes the spring to be compressed and the lever of the valve to be in a position such that air is prevented from passing therethrough. Once the ball is struck, the spring forces the plunger into an operative position which causes the groove of the plunger to actuate the lever of the valve, thereby causing the valve to vent air therethrough.

In another alternative embodiment, the apparatus is adapted to receive a tee cap which is threadably coupled to a block in which the apparatus is disposed. The tee cap is provided to insure that the tee is held in place and located concentrically to the outside diameter of the block assembly. Additionally, there should be sufficient space in the tee cap cavity to allow for vertical movement of the tee to permit actuation of the valve and to absorb shock forces on the tee when the ball is struck.

BRIEF DESCRIPTION OF THE DRAWINGS

The invention will be described in detail herein with reference to the following drawings in which like reference numerals refer to like elements throughout the several views, and wherein.

DETAILED DESCRIPTION OF PREFERRED EMBODIMENTS

The figures show a preferred embodiment of the apparatus of the present invention in various views. While the various drawings and descriptions are directed to an embodiment of the apparatus adapted for use in an automatic golf ball teeing system, such as that shown in my previous invention U.S. Pat. No. 5,348,305, the disclosure of which is hereby incorporated by reference in its entirety herein, the invention is in no way limited to such an embodiment. As will be clear to one of ordinary skill in the art, the essence of the invention lies in the detection of the presence or absence of an object and actuation of a pneumatic circuit based on such detection.

Figure 1:
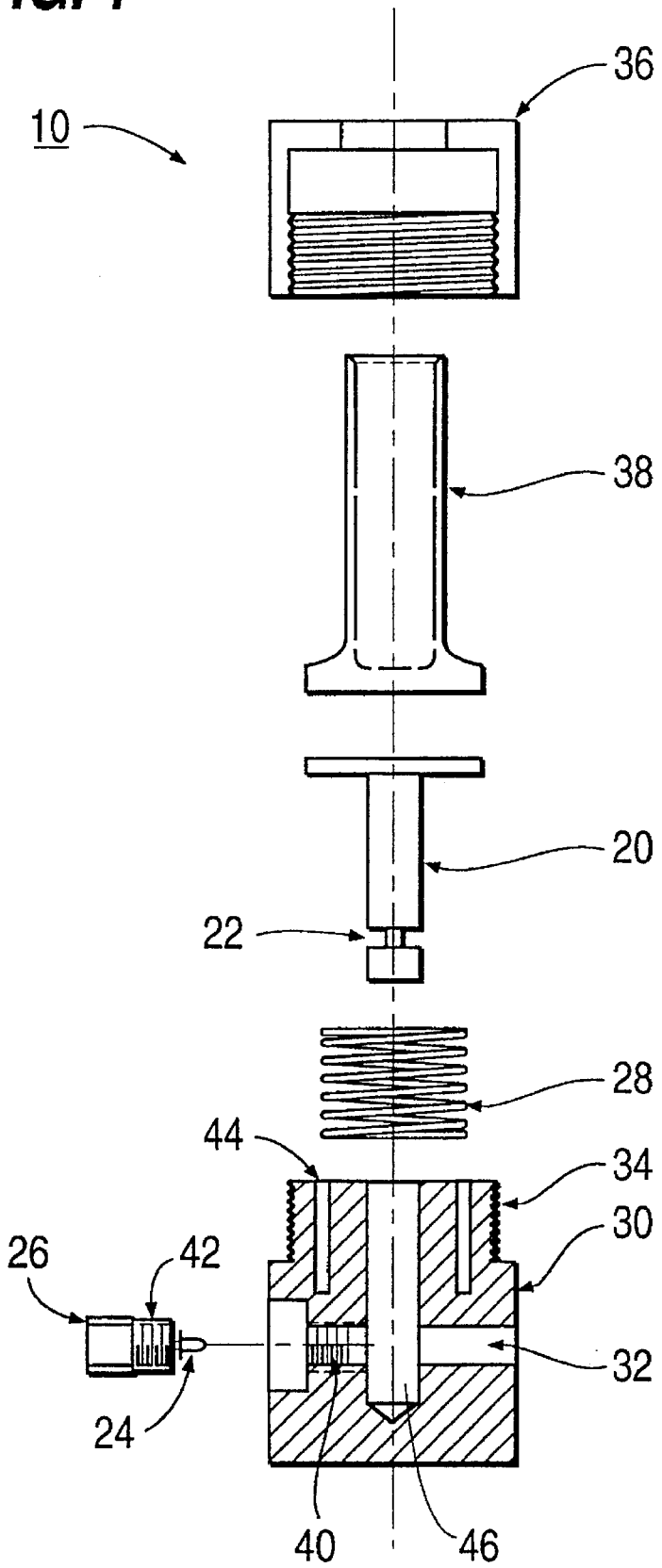
FIG. 1 is an exploded view of a preferred embodiment of the present invention.

Turning now to FIG. 1, a preferred embodiment of the present invention is shown in exploded view. The apparatus 10 includes a plunger 20 having a groove 22. The groove 22 is formed to receive an actuating lever 24 of a valve 26 (e.g., a "whisker valve") that controls air flow of the pneumatic circuit (shown in FIGS. 4 and 5). The plunger 20 rests on a spring 28, and the entire assembly is housed in a block 30 which is adapted to receive the spring 28, the plunger 20 and the valve 26. The spring is partially housed in a generally circular groove 44 formed in the block 30. A portion of the spring 28 remains above the block and the plunger 20 rests on this exposed portion of the spring 28. The block 30 also contains a channel 46 for receiving the part of the plunger 20 in which the groove 22 is disposed. In addition, the block 30 provides a channel 32 from which vented air is allowed to escape when the lever 24 of the valve 26 is put into an actuated position by movement of the groove 22. Additionally, in a preferred embodiment, the block 30 is provided with threads 34 which are adapted to receive a tee cap 36. The tee cap 36 is provided to insure that a hollow rubber tee 38, which is disposed to engage the plunger 20, is held securely in an upright position. The tee cap 36 provides ample inside clearance to allow the rubber tee 38 and the spring-loaded plunger 20 to move vertically a distance sufficient to actuate the valve 26. The inside clearance of the tee cap 36 also provides ample space for the tee 38 to flex and absorb shock upon being struck by an object, such as, for example, a golf club, while preventing undue strain on the other members of the apparatus. The tee cap 36 also provides for easy replacement of rubber tees 38, which become quickly worn by being constantly struck. The block 30 is also preferably provided with a threaded receptacle 40 for receiving a threaded portion 42 of the valve 26. Providing threaded connections to peripheral devices connected thereto, the block 30 is allowed to maintain an air-tight environment that is critical to maintain efficiency in a pneumatic environment.

Figure 2:
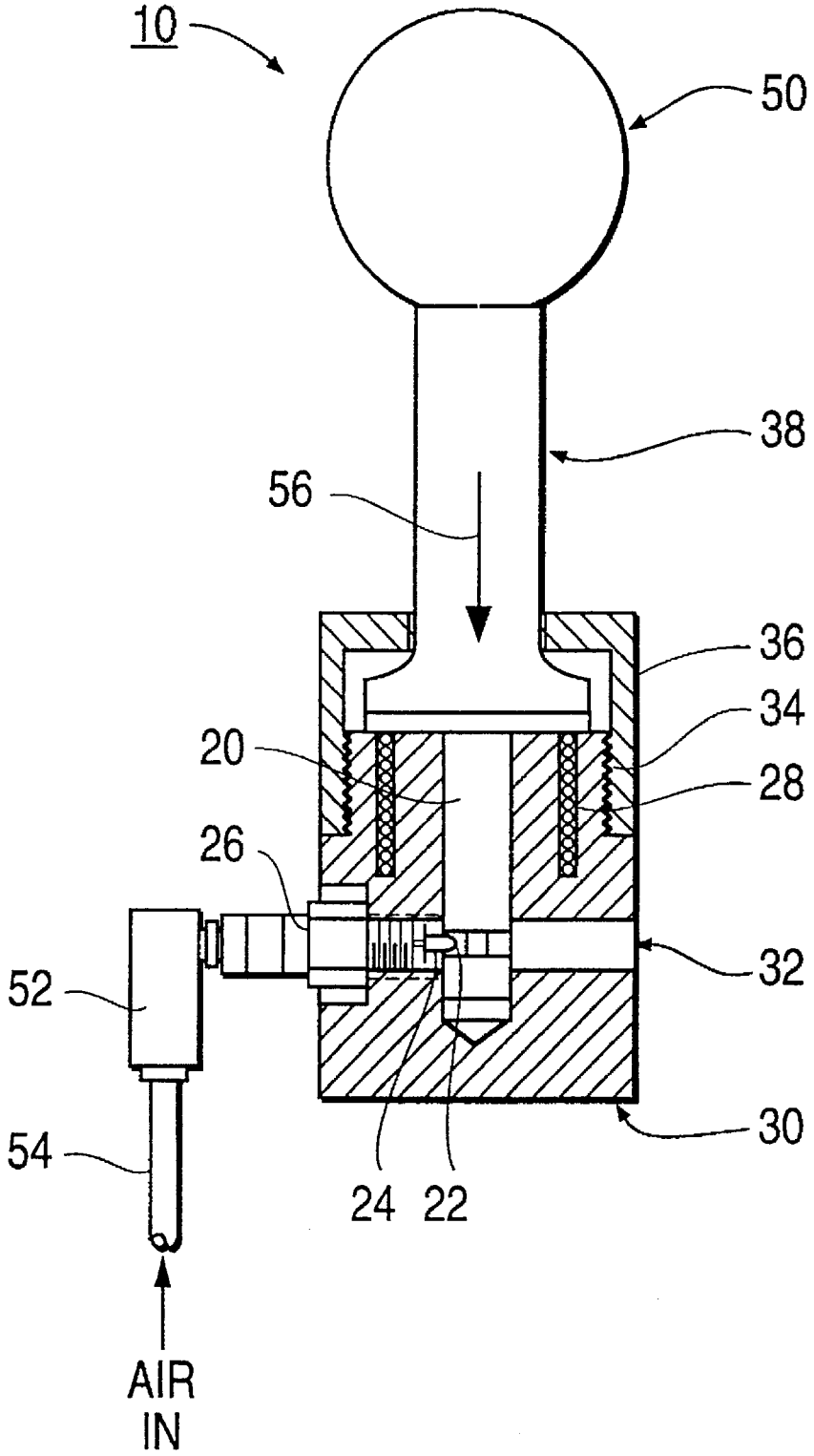
FIG. 2 is a cross-sectional view of a preferred embodiment of the present invention showing operation of the apparatus when an object is present.
Figure 3:
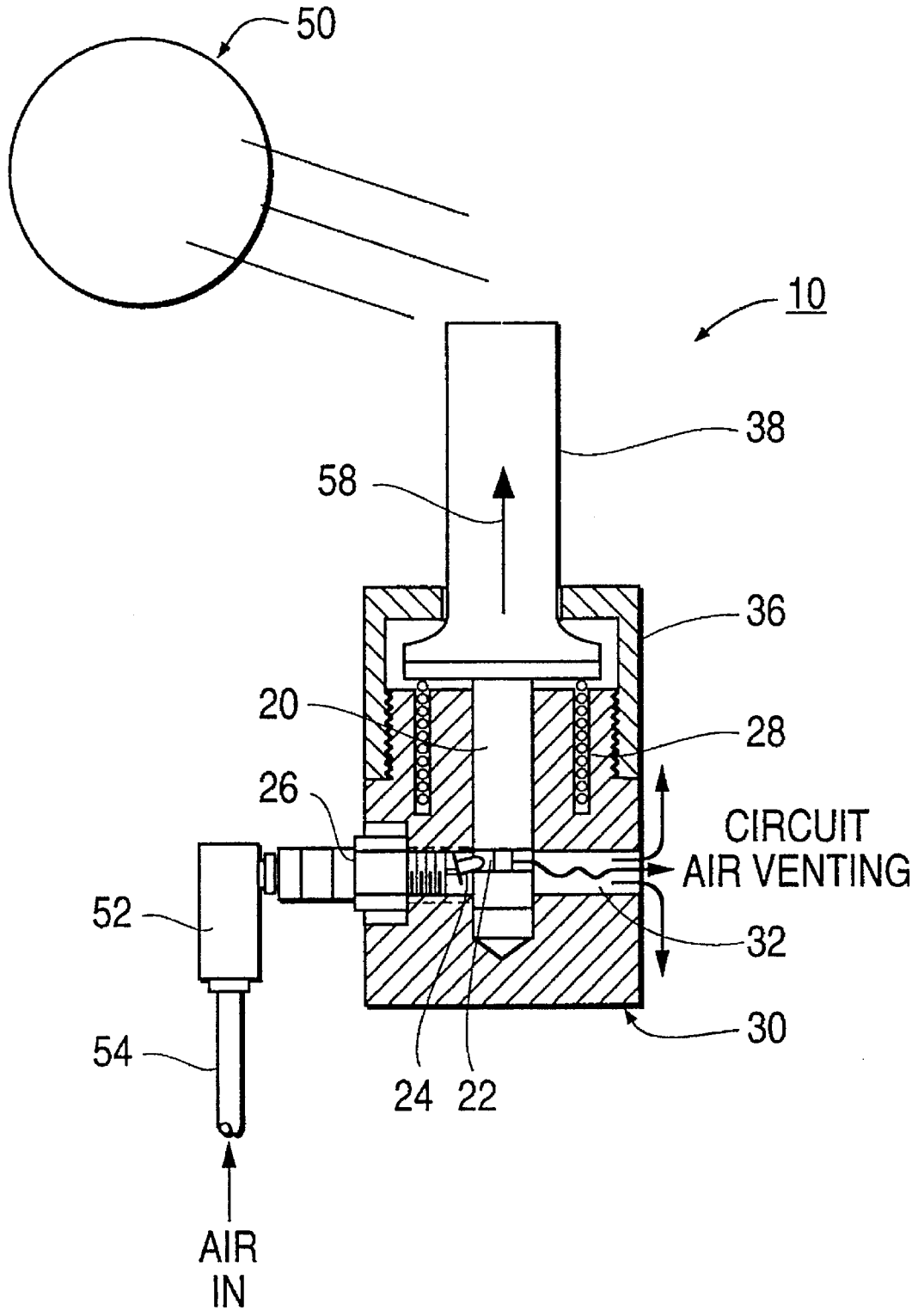
FIG. 3 is the cross-sectional view of FIG. 2 when no object is present.

Referring now to FIGS. 2 and 3, the operation of the apparatus 10 of the present invention is shown sequentially. Initially, an object 50, such as, for example, a golf ball, is at rest on the apparatus 10. The weight of the object 50 exerts a downward force in the direction of the arrow 56. The downward force created by the object 50 is sufficient to compress the spring 28 such that the groove 22 of the plunger 20 accommodates the lever 24 of the valve 26 in a resting position wherein air is prevented from escaping from the valve 26. It is important to note that the tension of the spring 28 should be selected such that a small weight, such as, for example, in the order of two ounces, is sufficient to compress the spring such that the groove 22 does not actuate the lever 24. However, the spring 28 should also have sufficient tension to cause the groove 22 to actuate the lever 24 when the object 50 is removed from the apparatus 10. In the rest configuration shown in FIG. 2, air from a fixed orifice of the pneumatic circuit (not shown here) passes through the tube 54 and is introduced to the valve 26 via connector 52. At rest, no air passes through the valve and the air of the pneumatic circuit is forced to a cylinder of the circuit as described below with respect to FIGS. 4 and 5.

FIG. 3 shows the configuration of the apparatus 10 once the object 50 is removed therefrom. When the object 50 is removed, such as, for example, a golf ball being struck by a golf club, the spring 28, which was previously held down by the weight of the object 50, is returned to its normal position. The tension in the spring 28 causes the plunger 20, and therefore, the tee 38, to be forced in the direction of the arrow 58. The upward movement of the plunger 20 causes the groove 22 to engage the lever 24 to actuate the valve 26. Actuation of the valve 26 causes circuit air from the pneumatic circuit to be vented through the opening 32. This venting of air causes the cylinder of the pneumatic circuit (not shown) to contract and actuates the ball replacing mechanism (not shown). Once another object 50 is placed on the tee 38, the groove 22 will force the lever 24 to close the valve 26, thereby bringing the pneumatic circuit to rest as described above with respect to FIG. 2.

Figure 4:
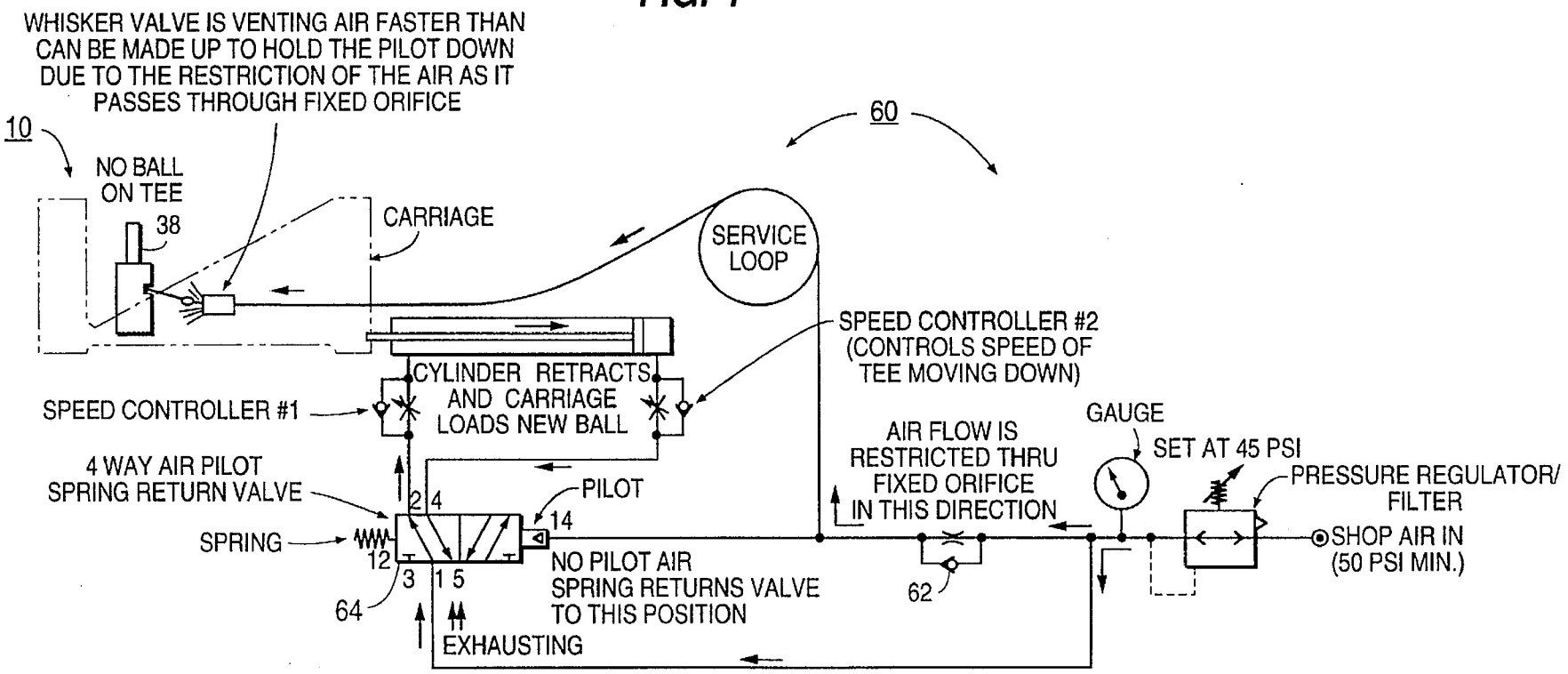
FIG. 4 is a schematic view of the pneumatic circuit when the apparatus detects that no object is present.
Figure 5:
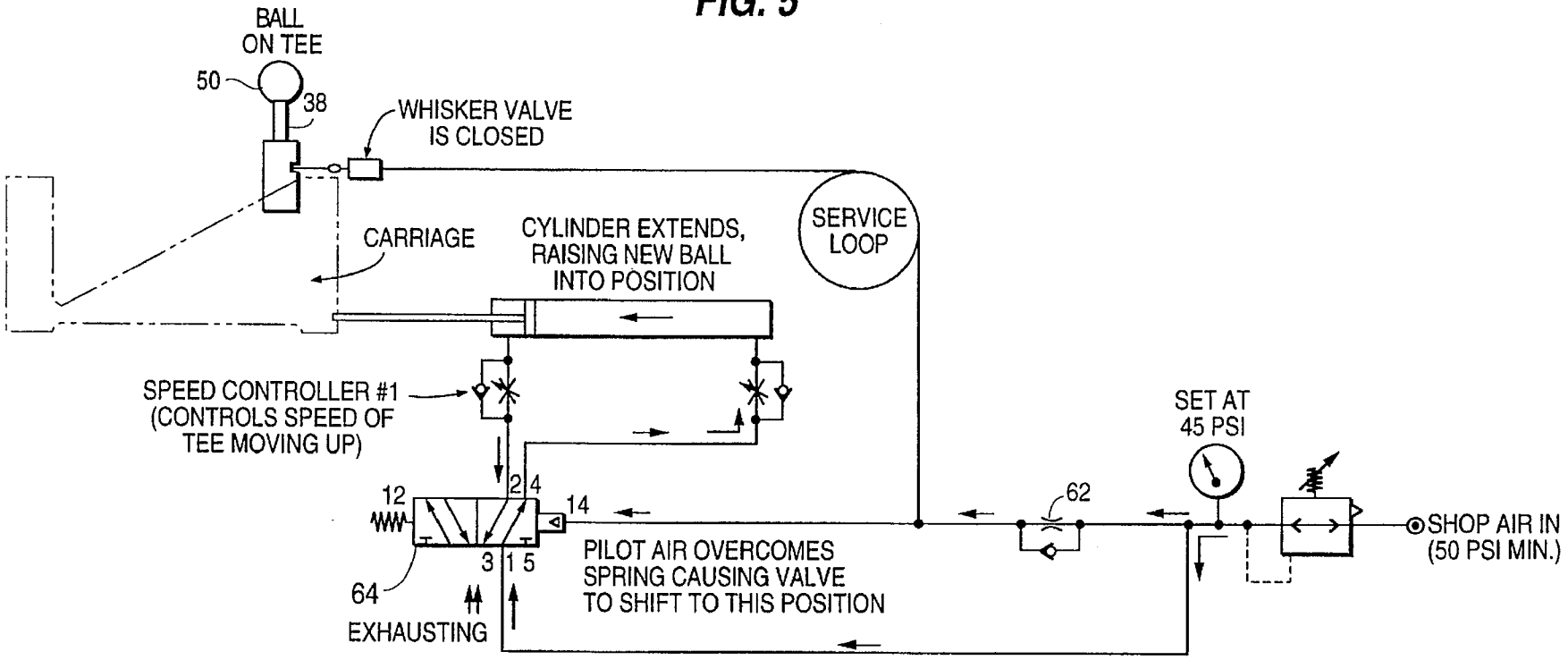
FIG. 5 is a schematic view of the pneumatic circuit when the apparatus is at rest with an object present.

FIGS. 4 and 5 show operation of the pneumatic circuit 60 when an object 50 is absent from the apparatus 10 and when an object 50 is present on the apparatus 10, respectively. The pneumatic circuit 60 includes an air pilot/spring return valve, such as, for example, a 5-port, 4-way, air pilot/spring return valve 64, and a reduced orifice 62 to restrict the flow of compressed air. In the embodiment shown, the presence of an object 50, such as, for example, a golf ball, on the rubber tee 38 overcomes the force of the spring 28 under the plunger 20, thus keeping the plunger in a downward position and causing the groove 22 of the plunger 20 to keep the lever 24 of the valve 26 in a position that keeps the valve 26 closed so that air is prevented from passing therethrough. Thus, the full pressure of the compressed air is directed to the pilot of the 4-way valve 64, overriding the force of its spring return. The 4-way valve 64 shifts, causing the pneumatic circuit 60 to actuate and come to rest for as long as the object 50 remains in place. In this rest state, no compressed air is wasted.

When the object 50 is struck or otherwise removed, the spring 28 causes the plunger 20 upward, thereby moving the groove 22 to actuate the lever 24, thus permitting air to be vented through the valve 26. The vented air is passed through the opening 32 provided in the block 30. Compressed air is vented through the valve 26 faster than the supply to the pilot of the 4-way valve 64 can be made up. This is due to the restricted flow through the reduced orifice 62. The force of the 4-way valve's 64 return spring shifts the 4-way valve 64 to its reverse position, thereby reversing the pneumatic circuit and causing actuation of the reciprocating device of the golf ball teeing apparatus, shown in my U.S. Pat. No. 5,348,305, to await the presence of another object 50 on the tee 38. In this manner, through mechanical or other means, a continuous supply of objects may be fed onto the tee 38 and hit by the user without the need for manual intervention.

While the invention has been described in conjunction with specific embodiments thereof, it is evident that many alternatives, modifications and variations will be apparent to those skilled in the art. Accordingly, the preferred embodiments of the invention, as set forth herein, are intended to be illustrative, not limiting. Various changes may be made without departing from the true spirit and full scope of the invention, as defined in the following claims.

What is claimed is:

1. An apparatus for sensing the presence or absence of an object, comprising:

a plunger adapted to receive the object, said plunger having a groove formed therein, said groove being adapted to receive a controlling lever of a valve;

a valve for controlling air flow in a pneumatic actuating circuit, said valve having a lever operatively coupled thereto for venting and preventing air flow through said valve, said lever being operatively engaged with said groove of said plunger; and a spring having a predetermined tension, said plunger being operatively coupled to said spring, wherein said spring forces said plunger into an operative position when no object is present, said operative position causing said groove to actuate said lever of said valve to vent air through said valve.

2. The apparatus of claim 1, further comprising a tee disposed on said plunger, said tee being adapted to hold the object and to engage said plunger based on the presence or absence of said object.

3. The apparatus of claim 2, further comprising a tee cap, said tee cap being adapted to hold said tee in a vertical orientation.

4. The apparatus of claim 1, wherein said valve is a whisker valve.

5. An apparatus for sensing the presence or absence of an object, comprising:

a tee for holding said object;

a plunger operatively engaged with said tee, said plunger having a groove formed therein, said groove being adapted to receive a controlling lever of a valve;

a valve for controlling air flow in a pneumatic actuating circuit, said valve having a lever operatively coupled thereto for venting and preventing air flow through said valve, said lever being operatively engaged with said groove of said plunger;

a spring having a predetermined tension, said plunger being operatively coupled to said spring, wherein said spring forces said plunger into an operative position when no object is present, said operative position causing said groove to actuate said lever of said valve to vent air through said valve; and a housing block for housing said plunger, said valve and said spring.

6. The apparatus of claim 5, further comprising a tee cap, wherein said housing block is adapted to receive said tee cap, said tee cap being threadably coupled to a top portion of said housing and adapted to hold said tee in a vertical position.

7. The apparatus of claim 5, wherein said valve is threadably coupled to said housing block.

8. The apparatus of claim 7, wherein said housing block includes a port for venting air when said valve is actuated.

9. The apparatus of claim 5, wherein said predetermined tension of said spring is selected to cause compression of the spring by the weight of a golf ball, said compression being adequate to keep the plunger and groove in a position wherein the lever does not actuate the valve.

10. The apparatus of claim 5, wherein the valve is coupled to a pneumatic circuit, said pneumatic circuit comprising:

a compressed air supply coupled to a reduced orifice;

an air pilot/spring return valve coupled to said reduced orifice;

said valve being disposed between said reduced orifice and said air pilot/spring return valve; and a cylinder for receiving compressed air from said air pilot/spring return valve when said valve is not actuated.

11. The apparatus of claim 10, wherein said pneumatic circuit engages an actuator when the object is absent, said actuator effecting automatic replacement of another object on said apparatus.

* * * * *